US011344753B2

(12) United States Patent
Wang

(10) Patent No.: US 11,344,753 B2
(45) Date of Patent: May 31, 2022

(54) PARTITION PLATE DEVICE OF A RESPIRATOR MASK

(71) Applicant: Ning-Chu Wang, Taichung (TW)

(72) Inventor: Ning-Chu Wang, Taichung (TW)

( * ) Notice: Subject to any disclaimer, the term of this patent is extended or adjusted under 35 U.S.C. 154(b) by 127 days.

(21) Appl. No.: 16/014,310

(22) Filed: Jun. 21, 2018

(65) Prior Publication Data

US 2018/0369618 A1 Dec. 27, 2018

(30) Foreign Application Priority Data

Jun. 23, 2017 (TW) ..... 106121089

(51) Int. Cl.

| | |
|---|---|
| ***A62B 18/10*** | (2006.01) |
| ***A62B 23/02*** | (2006.01) |
| ***A62B 18/02*** | (2006.01) |
| ***A62B 18/08*** | (2006.01) |
| ***A62B 7/10*** | (2006.01) |
| ***A41D 13/11*** | (2006.01) |

(52) U.S. Cl.

CPC ..... *A62B 18/10* (2013.01); *A62B 18/02* (2013.01); *A62B 23/025* (2013.01); *A41D 13/1138* (2013.01); *A62B 7/10* (2013.01); *A62B 18/084* (2013.01)

(58) Field of Classification Search

CPC ..... A62B 18/10; A62B 23/025; A62B 18/02; A62B 18/084; A62B 7/10; A62B 9/00; A62B 9/02; A62B 18/08; A41D 13/1138; A41D 13/11; A61M 16/06–069; A61M 16/20–209

USPC ..... 128/205.25

See application file for complete search history.

(56) References Cited

U.S. PATENT DOCUMENTS 1,695,170 A * 12/1928 Burdick ..... A62B 18/00 128/207.12
2,260,701 A * 10/1941 Boothby ..... A61M 16/06 128/205.17
2,788,001 A * 4/1957 Brown ..... A62B 9/00 128/205.17

(Continued)

FOREIGN PATENT DOCUMENTS

TW M258752 3/2005

OTHER PUBLICATIONS

Jensen et al., "Effects of dead space loading on neuro-muscular and neuro-ventilatory coupling of the respiratory system during exercise in healthy adults: Implications for dyspnea and exercise tolerance" *Respirator Physiology & Neurobiology*, vol. 179, Nos. 2-3: 219-226 2011.

*Primary Examiner* — Victoria Murphy
(74) *Attorney, Agent, or Firm* — Nixon & Vanderhye PC

(57) ABSTRACT

A partition plate device of a respirator mask includes a partition plate having an upside surface and a downside surface each cooperating with a mask body and a user's face to define an upper chamber and a lower chamber, respectively, a mask connecting rims for connecting against an inner surface of the mask body a user connecting rim for contacting the user's face, and at least one valve hole extending through the upside and downside surfaces and communicating with the upper and lower chambers. A valve unit includes at least one valve flap covering the valve hole and being movable away from the same to permit air in the lower chamber to flow in a single direction to the upper chamber.

10 Claims, 11 Drawing Sheets

(56) References Cited

U.S. PATENT DOCUMENTS 2,810,386 A * 10/1957 Reed ..... A62B 18/08 128/201.15
2,895,472 A * 7/1959 Matheson ..... A62B 23/02 128/206.15
3,521,626 A * 7/1970 Tokoroyama ..... B63C 11/14 128/201.19
4,574,799 A * 3/1986 Warncke ..... A62B 18/02 128/206.24
5,243,972 A * 9/1993 Huang ..... A62B 18/025 128/205.22
5,460,174 A * 10/1995 Chang ..... A62B 9/022 128/204.25
6,192,876 B1 * 2/2001 Denyer ..... A61B 5/087 128/204.18
6,530,373 B1 * 3/2003 Patron ..... A61M 16/06 128/205.25
7,909,035 B2 * 3/2011 Thornton ..... A61M 16/0866 128/206.21
8,397,724 B2 * 3/2013 Sher ..... A61M 16/20 128/205.25
9,399,105 B2 * 7/2016 Frater ..... A61M 16/065
2002/0139366 A1 * 10/2002 Gaschke ..... A62B 9/003 128/201.13
2003/0145858 A1 * 8/2003 Cardarelli ..... A61F 9/045 128/206.22
2004/0226563 A1 * 11/2004 Xu ..... A62B 18/02 128/206.21
2005/0199238 A1 * 9/2005 Ciou ..... A62B 23/06 128/205.25
2006/0081250 A1 * 4/2006 Bordewick ..... A61M 16/0418 128/206.11
2006/0249159 A1 * 11/2006 Ho ..... A61M 16/06 128/207.13
2008/0245364 A1 * 10/2008 Patterson ..... A62B 18/10 128/201.25
2009/0050144 A1 * 2/2009 Pierce ..... A61F 5/56 128/200.24
2010/0059058 A1 * 3/2010 Kuo ..... A61M 16/0638 128/205.25
2016/0158474 A1 * 6/2016 Harrison ..... A61M 16/105 128/201.13
2017/0119986 A1 * 5/2017 Poree ..... A61M 15/0086
2017/0157435 A1 * 6/2017 Choi ..... A61F 11/14

* cited by examiner

PARTITION PLATE DEVICE OF A RESPIRATOR MASK

CROSS-REFERENCE TO RELATED APPLICATION

This application claims priority to Taiwanese Patent Application No. 106121089, filed on Jun. 23, 2017.

FIELD

The disclosure relates to a respirator mask or filtering face mask, more particularly to a partition plate device of an air purifying respirator.

BACKGROUND

A respirator mask provides personal respiratory protection. Although a tight-fitting air purifying respirator can minimize leakage between the mask body thereof and the user's face and can ensure that the inhaled air can go through filter, because of this tight fitting engagement, many sorts of discomforts are experienced by the user. The most basic one of which is the accumulation of exhaled hot and humid air in the respirator. This problem can be remedied by mounting a partition plate inside the respirator for separating the mouth and the nose, so that air exhaled by the nose is limited in an upper chamber, and an area covering the user's face can be reduced to thereby provide a cooler feeling.

However, the mounting of the partition plate between the mouth and the nose causes difficulty in nasal breathing because it cuts off the airway from the lower chamber and reduces the breathable filtering area.

The foregoing breathing or inhaling problem can be solved, as long as a valve hole is provided in the partition plate and a one-way valve is mounted thereto. However, it is difficult to provide a partition plate having a one-way valve inside the respirator. These difficulties include mounting the partition plate inside the mask body, preventing deformation of the mask body which may cause leakage between the respirator and the user's face, achieving a one-way ventilation effect within a very narrow space, and fitting many changes and sizes of users' faces. Various types of valves currently used in the filtering face masks are not suitable for this application.

One study worth mentioning is the paper published in a journal by Dennis Jensen et al. in 2011 entitled "Respiratory Physiology & Neurobiology". This paper points out that, when the volume of the dead space is large, that is, the volume of an interior of the respirator accommodating air exhaled by the nose is large in comparison with a small volume of dead space, it will have many physical discomforts including exhaling large amount of carbon dioxide, rapid breathing per minute, large volume of moisture, high frequency of breathing, exertion of diaphragm muscle, large fluctuation of esophageal pressure, difficulty in breathing, etc. This paper provides a clear direction that by reducing the volume of the interior of the respirator accommodating the air exhaled by the nose, wear of the respirator will be more comfortable, so that willingness of the people to wear a tight-fitting air purifying respirator can be promoted.

Referring to FIG. 1, a respirator 1 having a parition layer, as disclosed in Taiwanese Patent No. M258752, includes a breathable main body 11, and a partition plate 12 disposed in an inner surface of the main body 11 and abutting against a user's face. The partition plate 12 cooperates with the main body 11 and the user's face to define an upper chamber 121 receiving the nose of the user and a lower chamber 122 receiving the mouth of the user. The upper and lower chambers 121, 122 are not communicating with each other. Through this, the nose and the mouth have individual breathing spaces.

Although the partition plate 12 can achieve the effect of separating the breathing spaces of the nose and the mouth, it also has the drawbacks as described above.

SUMMARY

Therefore, an object of the present disclosure is to provide a partition plate device of a respirator mask that can improve fresh air content in the respirator or filtering face mask, that can enhance coolness, dryness and comfort during wear of the filtering face mask, and that can promote willingness to use the filtering face mask.

According to one aspect of this disclosure, a partition plate device of a respirator mask, which has a mask body covering a user's face, includes a partition plate and a valve unit. The partition plate is configured to be disposed on an inner surface of the mask body and includes an upside surface configured to cooperate with the mask body and the user's face to define an upper chamber for receiving the nose of the user, a downside surface configured to cooperate with the mask body and the user's face to define a lower chamber for receiving the mouth of the user, a mask connecting rim configured to connect against the inner surface of the mask body, a user connecting rim opposite to the mask connecting rim and configured to contact the user's face, and at least one valve hole extending through the upside and downside surfaces and communicating with the upper and lower chambers. The upper and lower chambers are independent of each other. The valve unit is disposed on the upside surface of the partition plate and includes at least one valve flap covering the at least one valve hole and being movable away from the same to permit air in the lower chamber to flow in a single direction to the upper chamber.

Another object of the present disclosure is to provide a partition plate device of a respirator mask that is suitable for use by users having different shapes and sizes of faces and that can provide comfort during wear of the respirator.

According to another aspect of this disclosure, a partition plate device of a respirator mask includes a support seat, a partition plate and a valve unit. The support seat is configured to be fixed to an inner surface of the mask body and includes a supporting frame extending along the left-right direction, and a socket portion provided at one side of the supporting frame. The partition plate is configured to cooperate with the mask body and the user's face to define an upper chamber configured to receive the nose of the user and a lower chamber configured to receive the mouth of the user. The upper and lower chambers are independent of each other. The partition plate includes a mask connecting rim connecting against the supporting frame, a user connecting rim opposite to the mask connecting rim and configured to contact the user's face, at least one valve hole communicating with the upper and lower chambers, and a plug portion removably engaged to the socket portion. The valve unit is disposed on the partition plate and includes at least one valve flap covering the at least one valve hole and being movable away from the same to permit air in the lower chamber to flow in a single direction to the upper chamber.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
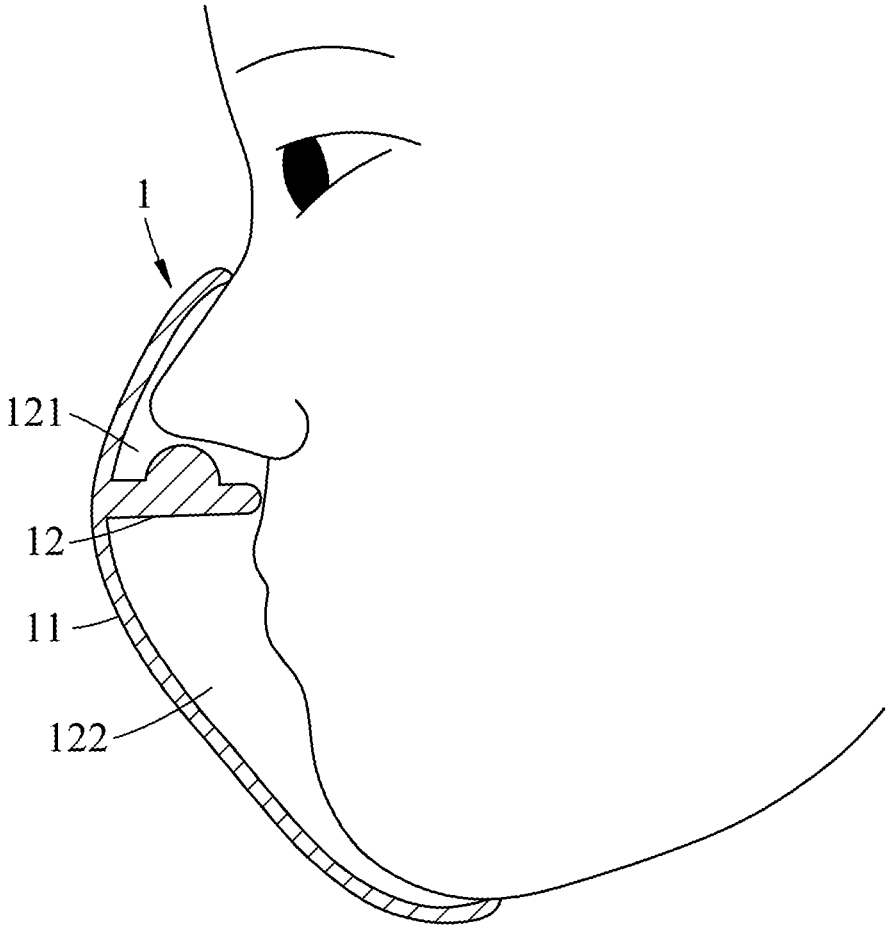
FIG.1 PRIOR ART
FIG. 1 is a sectional view of a respirator having a partition layer disclosed in Taiwanese Patent No. M258752 in a state of use.

Before the present disclosure is described in greater detail with reference to the accompanying embodiments, it should be noted herein that like elements are denoted by the same reference numerals throughout the disclosure.

Figure 2:
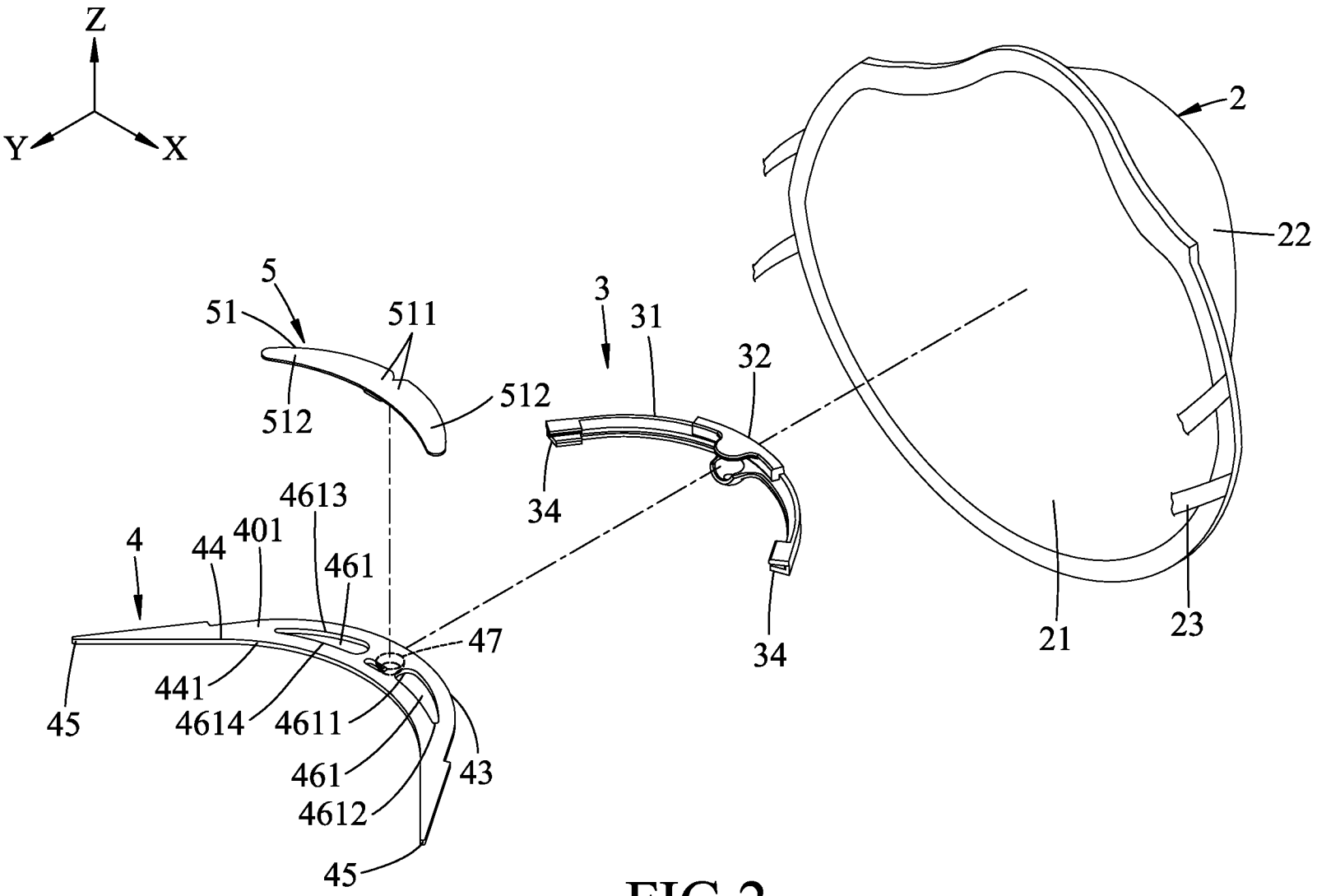
FIG. 2 is an exploded perspective view of a partition plate device of a respirator mask according to the first embodiment of this disclosure prior to connection with a mask body.
Figure 3:
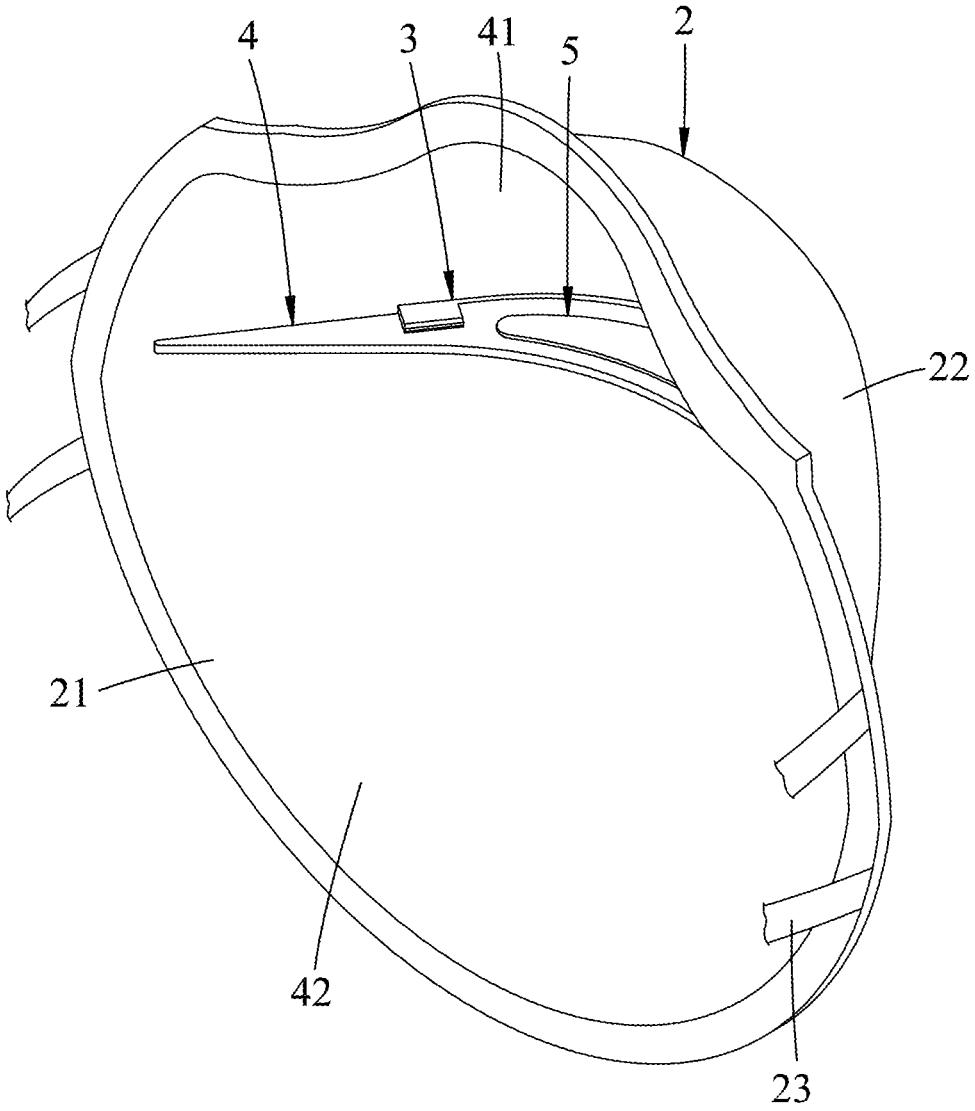
FIG. 3 is an assembled perspective view of FIG. 2.

Referring to FIGS. 2 and 3, a partition plate device of a respirator mask according to the first embodiment of the present disclosure is shown to include a support seat 3, a partition plate 4 and a valve unit 5. The respirator mask has a mask body 2 that is breathable and that has an inner surface 21 facing a user's face, an outer surface 22 opposite to the inner surface 21, and two straps 23 for securing the respirator mask to the user's head.

The support seat 3 is made of a non-rigid material. In this embodiment, the support seat 3 is fixed to the inner surface 21 of the mask body 2. However, in actual practice, the support seat 3 may be removably fixed to the inner surface 21 of the mask body 2 in a known manner. The support seat 3 of this embodiment includes a supporting frame 31 fixed to the inner surface 21 of the mask body 2 and extending along a left-right direction (X), a socket portion 32 connected to the center of the supporting frame 31, and two clamping portions 34 respectively connected to two opposite ends of the supporting frame 31.

Figure 4:
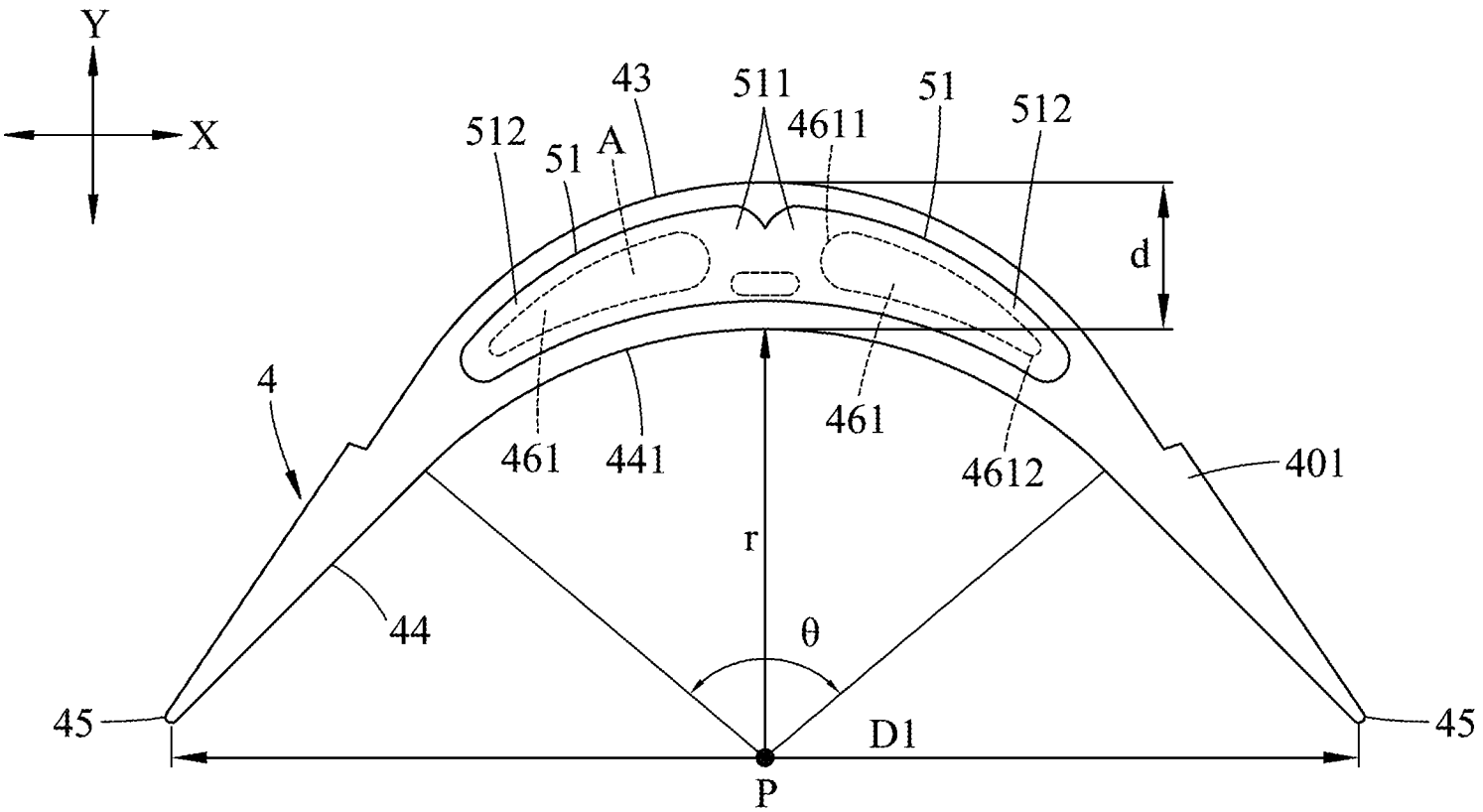
FIG. 4 is a top view of the first embodiment, illustrating a valve unit mounted on a top surface of a partition plate.
Figure 6:
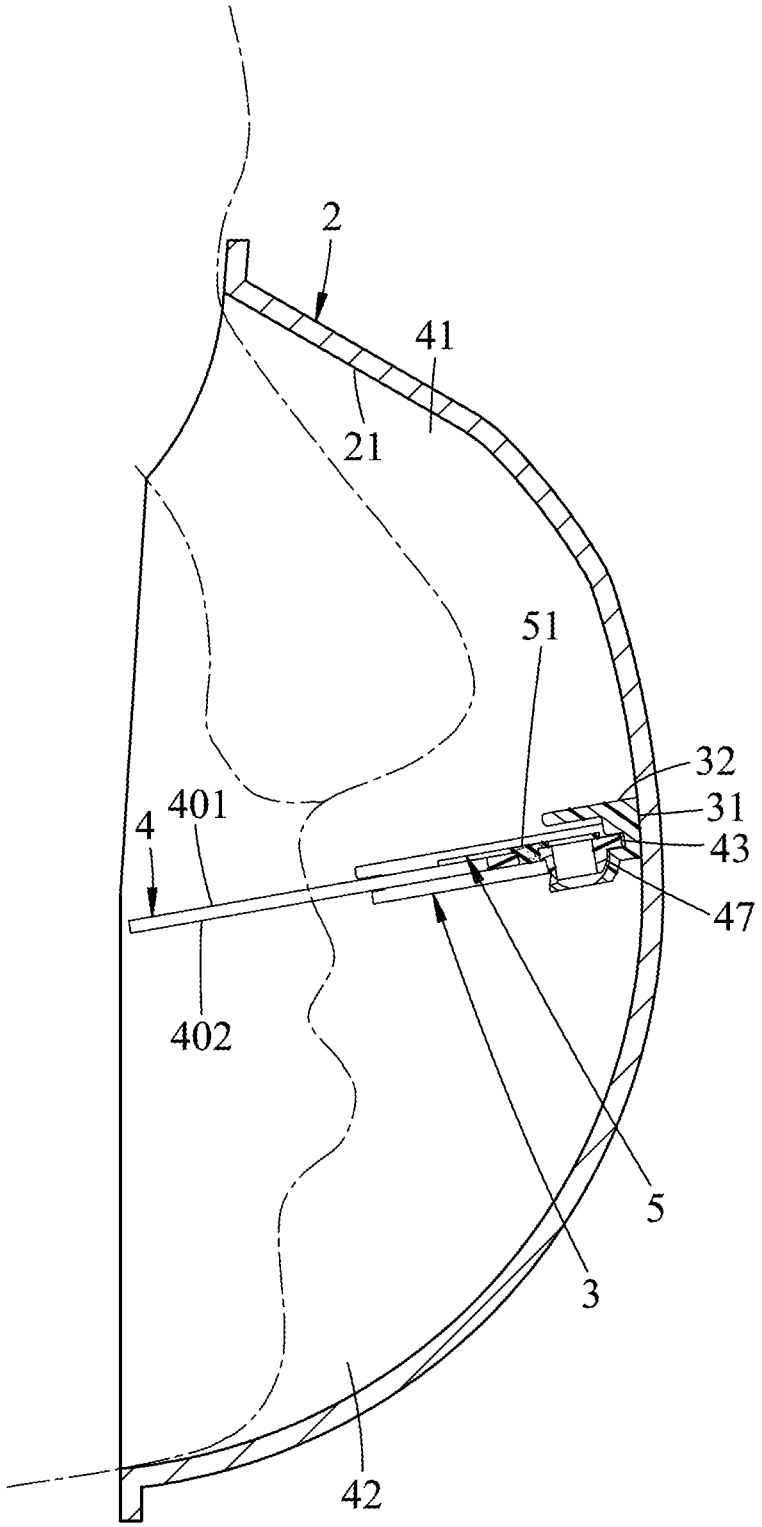
FIG. 6 is a sectional view of the first embodiment taken along line VI-VI of FIG. 5, illustrating how the first embodiment is worn on a user's face.

Referring to FIGS. 4 and 6, in combination with FIGS. 2 and 3, the partition plate 4 is removably mounted on the support seat 3, and includes an upside surface 401 cooperating with the mask body 2 and the user's face to define an upper chamber 41 for receiving the nose of the user, a downside surface 402 cooperating with the mask body 2 and the user's face to define a lower chamber 42 for receiving the mouth of the user, a mask connecting rim 43 that has a curved shape following a contour of the supporting frame 31 to connect against the same, a user connecting rim 44 opposite to the mask connecting rim 43 and contacting an upper lip of the user, two valve holes 461 extending through the upside and downside surfaces 401, 402 and communicating with the upper and lower chambers 41, 42, and a plug portion 47 removably received in the socket portion 32. The upper and lower chambers 41, 42 are independent of each other.

Figure 5:
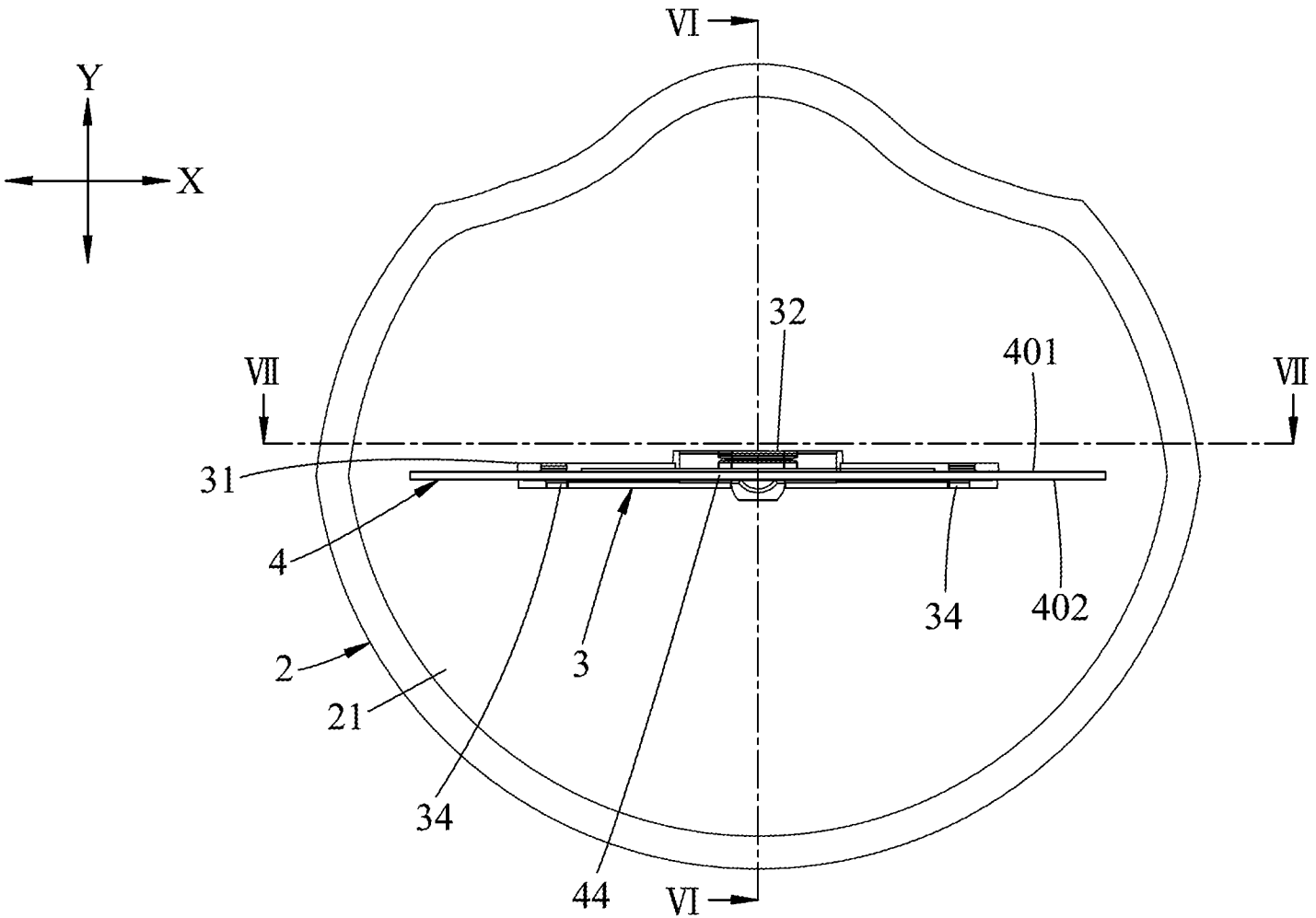
FIG. 5 is is a rear view of FIG. 3.
Figure 7:
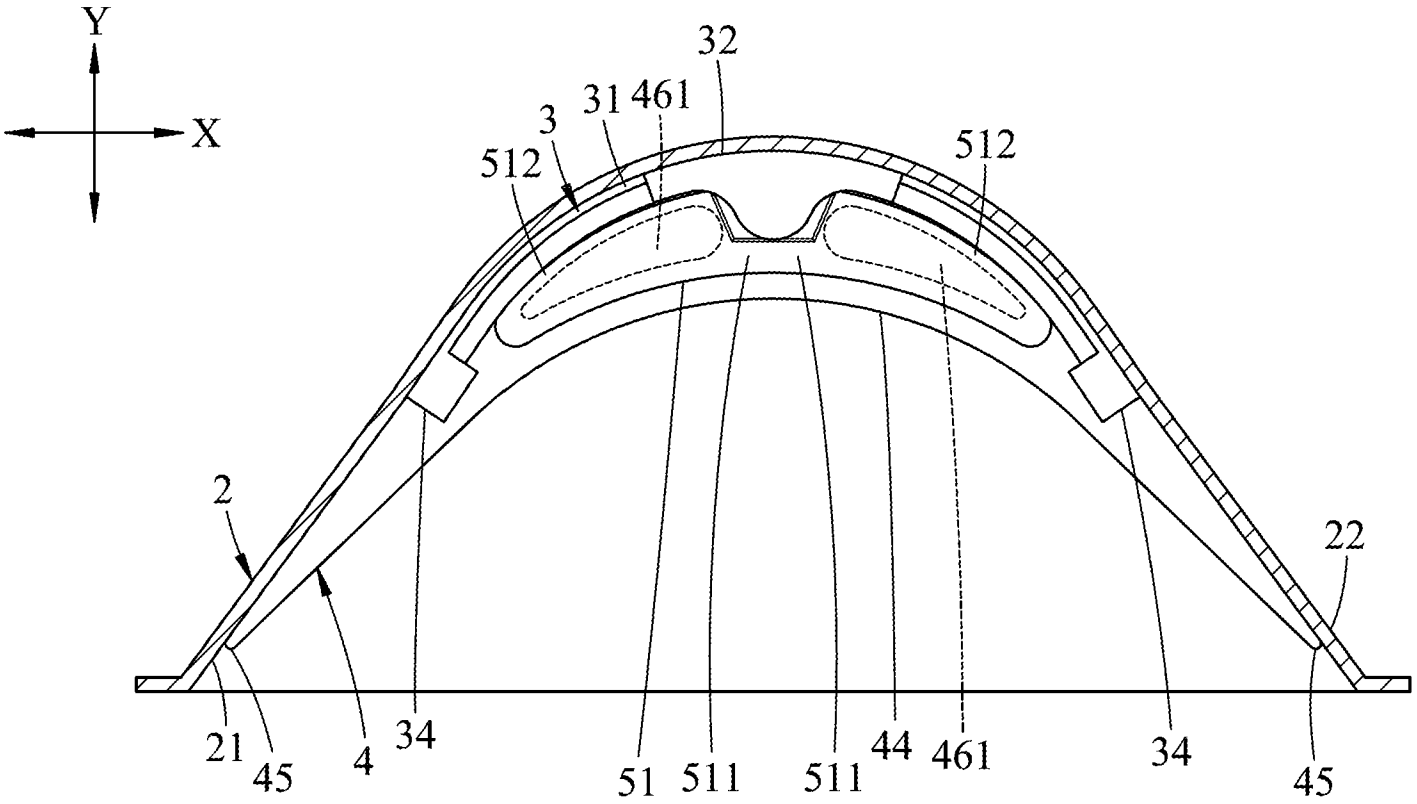
FIG. 7 is a top sectional view of the first embodiment taken along line VII-VII of FIG. 5.

Referring to FIG. 7, in combination with FIGS. 4 to 6, the largest distance (d) between the mask connecting rim 43 and the user connecting rim 44 is greater than 12 mm as measured in a front-rear direction (Y) transverse to the left-right direction (X) and the top-bottom direction (Z). The user connecting rim 44 has an arc segment 441 at a central portion thereof. The arc segment 441 has a radius (r) of between 30 mm and 50 mm, and subtends a central angle (θ) of between 80° and 160°. Preferably, the radius (r) of the arc segment 441 is between 36 mm and 45 mm, the central angle (θ) is between 100° and 140°, and the largest distance (d) is not smaller than 14.5 mm.

Left and right ends 45 of the partition plate 4 are spaced apart from each other by a first distance (D1) of between 65 mm and 130 mm as measured in the left-right direction (X). In this embodiment, the first distance (D1) is about 106 mm.

The valve holes 461 are spacedly formed in a central portion of the partition plate 4. The total area of all the valve holes 461 is between 80 $mm^2$ and 800 $mm^2$ for air to pass therethrough. Each valve hole 461 has a large hole end 4611 having the largest width in the front-rear direction (Y), and a small hole end 4612 opposite to the large hole end 4611 and having the smallest width in the front-rear direction (Y). The large hole end 4611 is close to the central portion of the partition plate 4. The small hole ends 4612 of the valve holes 461 are respectively close to the left and right ends 45. The width of each valve hole 461 gradually decreases from the large hole end 4611 toward the small hole end 4612. Preferably, the area (A) of each valve hole 461 ranges between 40 $mm^2$ and 310 $mm^2$, and more preferably between 50 $mm^2$ and 200 $mm^2$. When the largest distance (d) is 14.5 mm, the area (A) is 78.8 $mm^2$.

With reference to FIGS. 2 and 7, the valve unit 5 of this embodiment is disposed on the upside surface 401 of the partition plate 4, and includes two valve flaps 51 respectively covering the valve holes 461. Each of the valve flaps 51 has a fixed portion 511 fixed to the upside surface 401 at a position proximate to a respective one of the valve holes 461, and a movable portion 512 extending outwardly from the fixed portion 511 and covering the respective valve hole 461. The movable portion 512 can be moved by the air pressure difference between the lower and upper chambers 42, 41 to move away from the respective valve holes 461 so as to permit a portion of the air in the lower chamber 42 to flow in a single direction to the upper chamber 41.

The fixed portions 511 of the valve flaps 51 are integrally connected as one piece, and are located between the valve holes 461. The valve flaps 51 are almost the same shape as and slightly larger than the valve holes 461 to fully cover it.

With reference to FIGS. 4, 6 and 7, when the user inhales air through the mouth, ambient air is sucked into the lower chamber 42 through the mask body 2 to provide inhalation by the mouth.

When the user inhales air through the nose, one stream of ambient air is sucked into the lower chamber 42 through the mask body 2 with filter facepiece, and the stream of air pushes the valve flaps 51 to move away from the valve holes 461 to permit a portion of air in the lower chamber 42 to flow into the upper chamber 41. The other stream of air directly enters the upper chamber 41 through the mask body 2, and combines with the portion of air that enters the upper chamber 41 from the lower chamber 42 to increase the amount of air intake of the upper chamber 41 for providing inhalation by the nose. Through this, a sufficient amount of air can be inhaled by the nose, and there is no increasing of breathing resistance caused by a smaller filter area of the upper chamber 41.

When the user exhales air through the nose, the exhaled air pushes the valve flaps 51 to close the valve holes 461 of the partition plate 4, so that it cannot flow from the upper chamber 41 into the lower chamber 42, and is limited within the upper chamber 41 for discharge into the atmosphere through the mask body 2.

When the user exhales air through the mouth, apart from being discharged into the atmosphere through the mask body 2 from the lower chamber 42, a portion of the exhaled air will pass through the valve unit 5 and enter the upper chamber 41 for quick discharge into the atmosphere through the mask body 2. Repeating this, the amount of exhaled air in the lower chamber 42 is gradually reduced so that the amount of fresh air during inhalation can be increased. A sultry feeling during use of the respirator of this disclosure can then be reduced.

Referring again to FIGS. 4 and 7, it is worth to mention herein that the area (A) of each valve hole 461 of this embodiment is set between 40 $mm^2$ and 400 $mm^2$. When the area of each valve flap 51 is excessively large, each valve flap 51 may interfere with the other component (such as the mask body 2). On the other hand, if the total area of the valve holes 461 is smaller than 80 $mm^2$, a breathing resistance and a sultry feeling may arise.

Referring back to FIGS. 2 and 4, since the partition plate 4 can be removably connected to the support seat 3, and thus is replaceable, it is only necessary to vary the user connecting rim 44 of the partition plate 4 so as to change the radius (r) of the arc segment 441, the central angle (θ), the first distance (D1) between the left and right ends 45, and the largest distance (d) between the mask connecting rim 43 and the user connecting rim 44, so that the partition plate 4 may be suitable for users having different face shapes and sizes.

With reference again to FIGS. 6 and 7, to mount the partition plate 4 on the support seat 3 which is fixed to the inner surface 21 of the mask body 2, the partition plate 4 is simply pressed onto the support seat 3 along the front-rear direction (Y) to connect the mask connecting rim 43 against the supporting frame 31 and to allow the clamping portions 34 to clamp the upside and downside surfaces 401, 402 of the partition plate 4 at two opposite sides thereof. At this time, the plug portion 47 of the partition plate 4 is disposed in the socket portion 32 of the support seat 3. Thus, the partition plate 4 is connected to the mask body 2 through the support seat 3.

It is worth to mention herein that the height of the user connecting rim 44 of the partition plate 4 is larger than that of the mask connecting rim 43 thereof, so that when the user connecting rim 44 contacts the upper lip of the user, a wearing comfort and an abutment effect can be enhanced.

Figure 8:
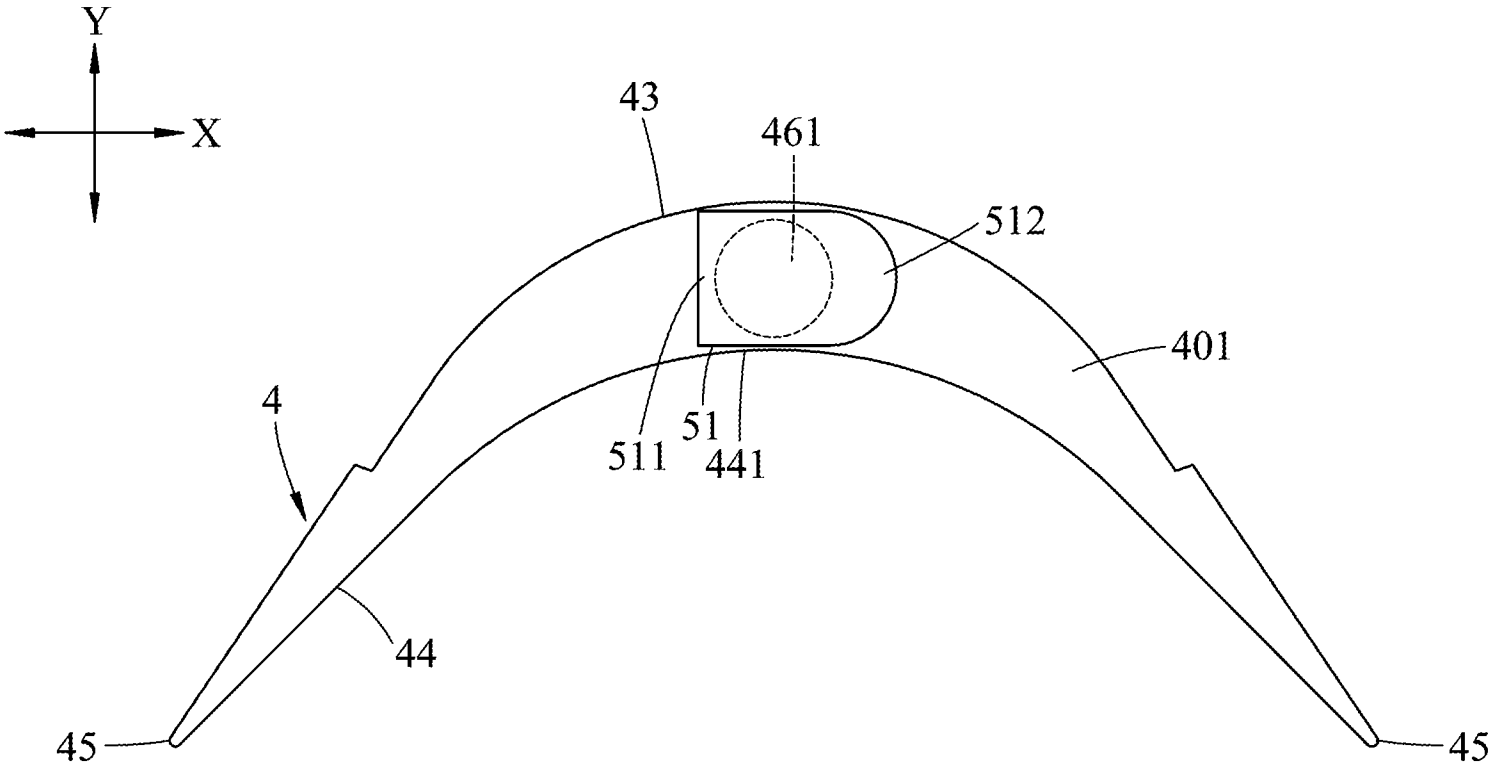
FIG. 8 is a top view, illustrating an alternative form of the partition plate of the first embodiment.

It should be noted herein that the number of each of the valve hole 461 and the valve flap 51 is not limited to two. In an alternative embodiment, the number of each of the valve hole 461 and the valve flap 51 may be one, as shown in FIG. 8. In this case, the valve flap 51 similarly has a fixed portion 511 fixed to the upside surface 401 of the partition plate 4 at a position proximate to the valve hole 461, a movable portion 512 extending outwardly from the fixed portion 511 and covering the valve hole 461. The movable portion 512 can similarly be pushed by the air to move away from the valve hole 461.

Figure 9:
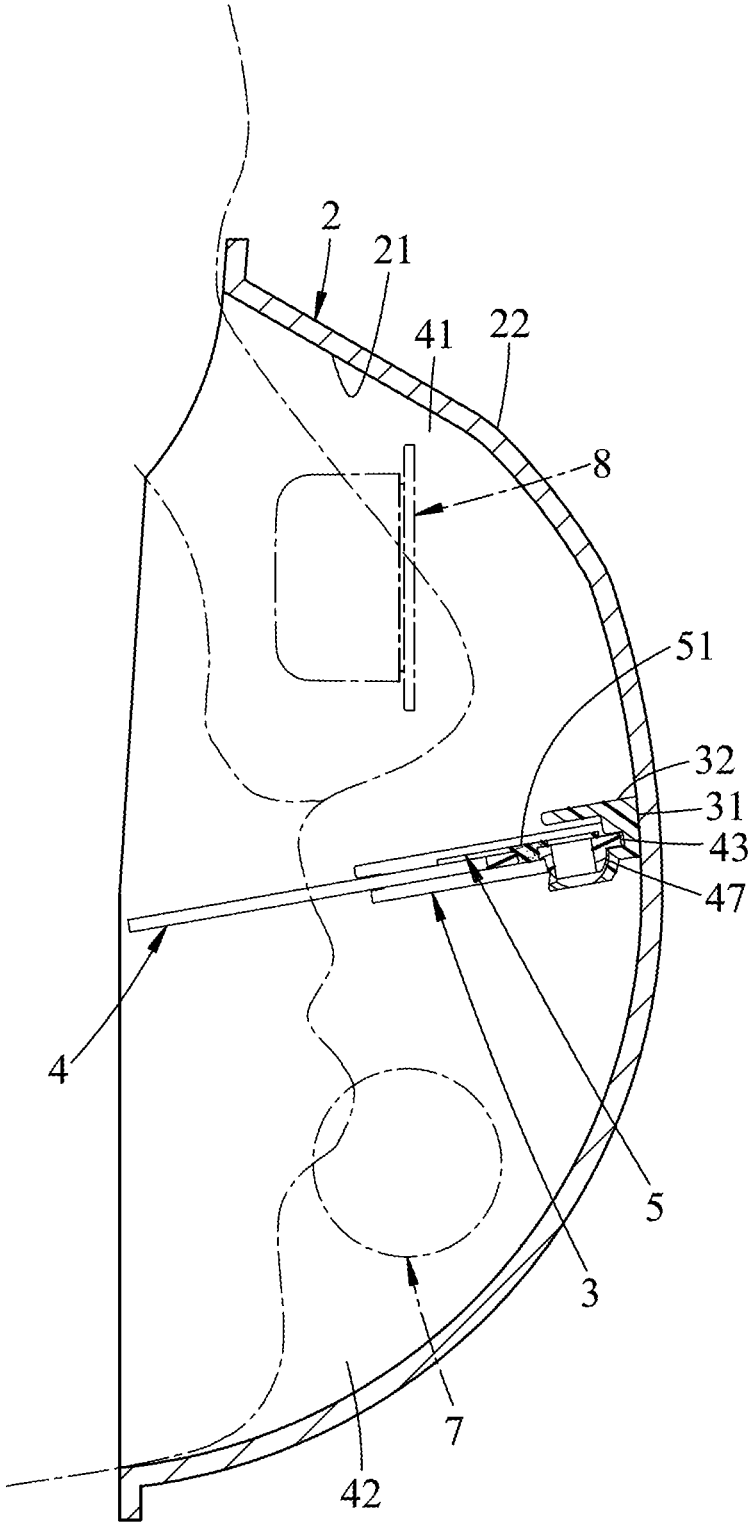
FIG. 9 is a sectional view, illustrating the partition plate device of the first embodiment used in an air-impermeable facepiece respirator.

In another alternative embodiment, as shown in FIG. 9, the partition plate device is used in an air-impermeable facepiece respirator, and further comprises a filter unit 7 (such as a filter cartridge or a vapor adsorption cartridge) and an exhalation valve 8. The filter unit 7 is mounted on the outer surface 22 of the mask body 2, and communicates with the lower chamber 42 for purifying air flowing in a single direction from the ambient atmosphere into the lower chamber 42. The exhalation valve 8 is mounted on the outer surface 22 of the mask body 2, and communicates with the upper chamber 41 for guiding air in the upper chamber 41 to discharge into the ambient atmosphere.

Figure 10:
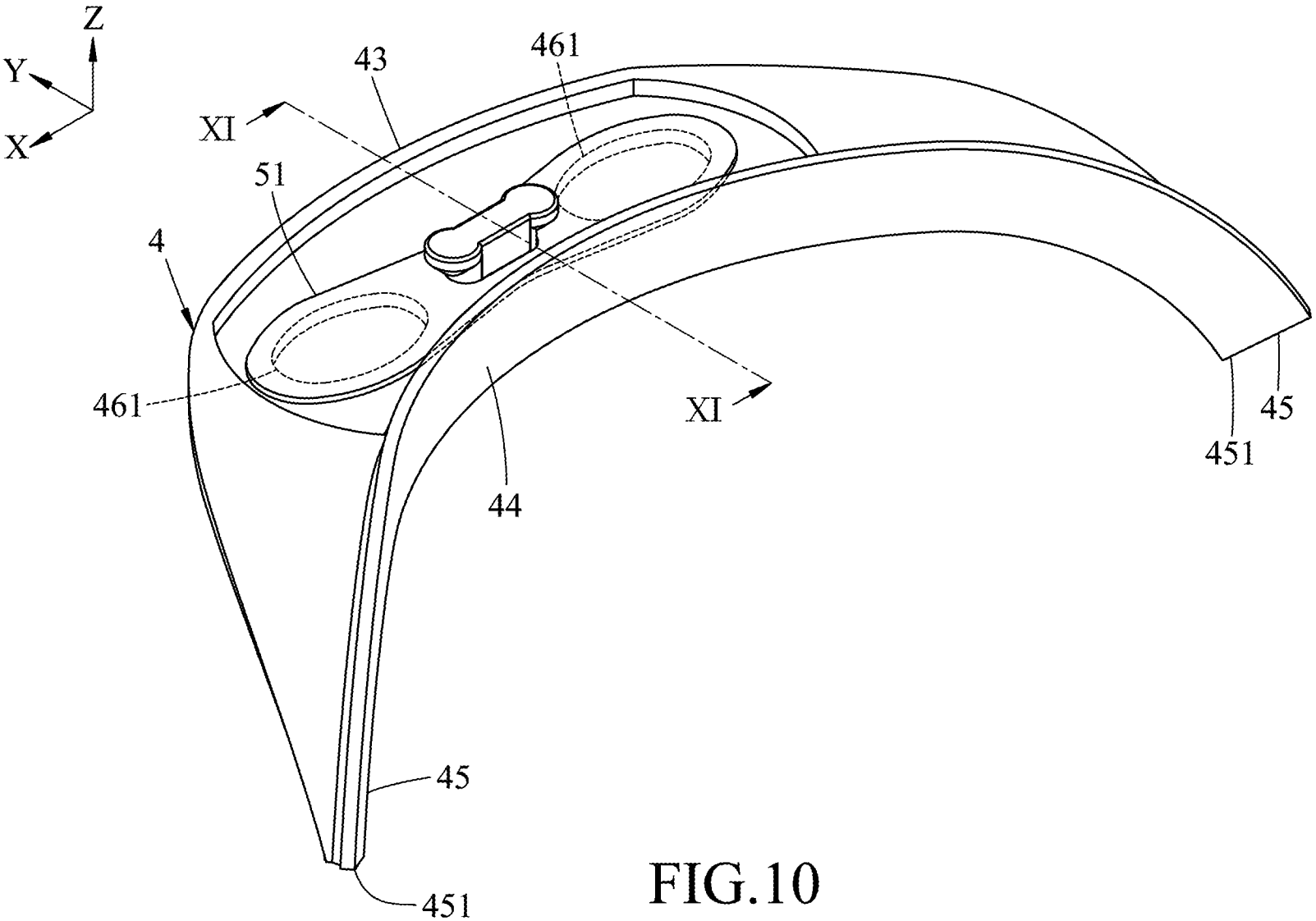
FIG. 10 is a perspective view of a partition plate device of a respirator mask according to the second embodiment of this disclosure.
Figure 11:
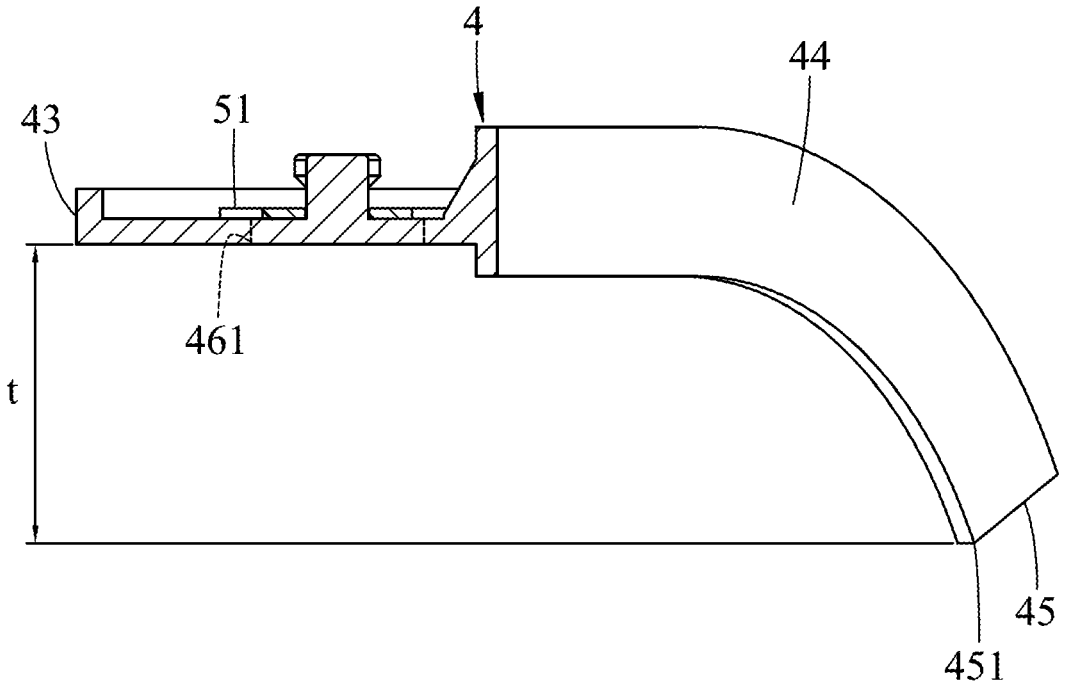
FIG. 11 is a sectional perspective view taken along line XI-XI of FIG. 9.

FIGS. 10 and 11 illustrate a partition plate 4 of the partition plate device of a respirator mask according to the second embodiment of of this disclosure. In this embodiment, the left and right ends 45 of the partition plate 4 are located below the valve holes 461, and each of the left and right ends 45 has a lowest point 451 spaced apart from a bottom end of the respective valve hole 461 by a distance (t) of greater than 5 mm as measured in the top-bottom direction (Z). The distance (t) is preferably between 10 mm and 20 mm. In this embodiment, the distance (t) is 15 mm, and the partition plate 4 has a bull horn shape. Through this, the user connecting rim 44 between the left and right ends 45 can coordinate with the bull-horn shaped partition plate 4 to contact more closely the user's face and reduce the interference with the mask body 2, thereby enhancing the airtight and protective effects.

From the foregoing description, the advantages of the present disclosure can be summarized as follows:

1. This disclosure uses the partition plate 4 to restrict the exhaled air from the nose in the upper chamber 41. Further, through coordination of the valve holes 461 and the valve flaps 51 of the valve unit 5 to control the flow of air in a single direction, the upper chamber 41 can have a portion of the air in the lower chamber 42, so that the amount of the exhaled air inside the respirator of this disclosure can be reduced, and the amount of inhaled fresh air can be increased. Hence, the respirator mask of this disclosure can be worn with comfort without breathing resistance and sultry feeling, so that willingness of the user to wear the respirator mask can be promoted.

2. Through the detachable configuration of the partition plate 4 and its connection relationship with the support seat 3, various sizes and shapes of the partition plates 4 can be changed to fit the user's face. Apart from that, less stretching of the mask body 2 leads to less leakage, thereby enhancing the protecting efficiency and wear comfort.

In the description above, for the purposes of explanation, numerous specific details have been set forth in order to provide a thorough understanding of the embodiment(s). It will be apparent, however, to one skilled in the art, that one or more other embodiments maybe practiced without some of these specific details.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A partition plate device of a respirator mask which has a mask body configured to cover a face of a user, said partition plate device comprising:

a partition plate configured to be disposed on an inner surface of the mask body and including an upside surface configured to cooperate with the mask body and the user's face to define an upper chamber for receiving a nose of the user, a downside surface configured to cooperate with the mask body and the face of the user to define a lower chamber for receiving a mouth of the user, a mask connecting rim configured to connect against the inner surface of the mask body, a user connecting rim opposite to said mask connecting rim and configured to contact the face of the user, and at least one valve hole extending through said upside surface and said downside surface and communicating with said upper chamber and said lower chamber; and a valve unit disposed on said upside surface of said partition plate and including at least one valve flap covering said at least one valve hole and being movable away from said at least one valve hole to permit air in said lower chamber to flow in a single direction to said upper chamber, wherein said at least one valve hole is defined by a hole-defining wall which includes two curved sections that are curved in a same direction and that are spaced apart from each other in a front-rear direction.

2. The partition plate device as claimed in claim 1, wherein said partition plate further includes a left end and a right end spaced apart from each other by a first distance of between 65 mm and 130 mm as measured in a left-right direction, and a largest distance between said mask connecting rim and said user connecting rim is greater than 12 mm as measured in the front-rear direction transverse to the left-right direction.

3. The partition plate device as claimed in claim 2, wherein said user connecting rim of said partition plate has an arc segment at a central portion thereof, said arc segment having a radius of between 30 mm and 50 mm, and subtending a central angle of between 80° and 160°.

4. The partition plate device as claimed in claim 2, wherein said partition plate is configured to be disposed removably on the inner surface of the mask body.

5. The partition plate device as claimed in claim 4, further comprising a support seat configured to be fixed to the inner surface of the mask body and including a supporting frame that follows a contour of said mask connecting rim of said partition plate and that extends along the left-right direction, and a socket portion connected to said supporting frame, said partition plate being removably mounted on said support seat, said mask connecting rim of said partition plate connecting against said supporting frame, said partition plate further including a plug portion removably received in said socket portion, said upside surface of said partition plate being configured to cooperate with said support seat, the mask body and the face of the user to define said upper chamber, said downside surface of said partition plate being configured to cooperate with said support seat, the mask body and the face of the user to define said lower chamber.

6. The partition plate device as claimed in claim 2, wherein said left end and said right end of said partition plate are located below said at least one valve hole, each of said left end and right end of said partition plate having a lowest point spaced apart from a bottom end of said hole-defining wall by a distance of greater than 5 mm as measured in a top-bottom direction transverse to the left-right direction and the front-rear direction.

7. The partition plate device as claimed in claim 1, wherein said at least one valve flap has a fixed portion fixed to said upside surface of said partition plate at a position proximate to said at least one valve hole, and a movable portion that extends outwardly from said fixed portion that covers said at least one valve hole and that works as a one-way valve, said at least one valve flap having a maximum length of below 50 mm and a minimum length of greater than 10 mm as measured in a left-right direction from said fixed portion to said movable portion.

8. The partition plate device as claimed in claim 7, wherein said at least one valve flap of said valve unit includes two valve flaps, said at least one valve hole of said partition plate includes two valve holes, wherein said two valve holes each have an area of between 40 $mm^2$ and 400 $mm^2$ for air to pass therethrough, said two valve flaps respectively covering said two valve holes.

9. The partition plate device as claimed in claim 8, wherein said fixed portions of said two valve flaps are integrally connected as one piece and are located between said two valve holes, said movable portions of said two valve flaps extending oppositely and respectively from said fixed portions.

10. A partition plate device of a respirator mask, comprising:

a support seat configured to be fixed to an inner surface of a mask body of the respirator mask and including a supporting frame extending along a left-right direction, and a socket portion provided at one side of said supporting frame; and a partition plate including an upside surface configured to cooperate with the mask body and a face of a user to define an upper chamber configured to receive a nose of the user, a downside surface configured to cooperate with the mask body and the face of the user to define a lower chamber configured to receive a mouth of the user, a mask connecting rim connecting against said supporting frame, a user connecting rim opposite to said mask connecting rim and configured to contact the face of the user, at least one valve hole communicating with said upper chamber and said lower chamber, and a plug portion removably engaged to said socket portion; and a valve unit disposed on said upside surface of said partition plate and including at least one valve flap covering said at least one valve hole and being movable away from said at least one valve hole to permit air in said lower chamber to flow in a single direction to said upper chamber, wherein said at least one valve hole is defined by a hole-defining wall which includes two curved sections that are curved in a same direction and that are spaced apart from each other in a front-rear direction.

* * * * *